US006010342A

United States Patent [19]

Watson

[11] Patent Number: 6,010,342

[45] Date of Patent: Jan. 4, 2000

[54] SLEEVELESS HIGH-DENSITY COMPRESSION CONNECTOR

[76] Inventor: Troy M. Watson, 5672 E. Kelso, Tucson, Ariz. 85712

[21] Appl. No.: 09/045,556

[22] Filed: Mar. 20, 1998

Related U.S. Application Data

[63] Continuation-in-part of application No. 08/752,713, Nov. 19, 1996, Pat. No. 5,755,596.

[51] Int. Cl.[7] ..... H01R 9/09

[52] U.S. Cl. ..... 439/78; 439/943; 439/289; 174/267

[58] Field of Search ..... 439/608, 55, 78, 439/733.1, 750, 943, 289; 174/261, 267

[56] References Cited

U.S. PATENT DOCUMENTS 3,114,194 12/1963 Lohs ..... 29/155.5
3,634,601 1/1972 Pauza .
4,679,321 7/1987 Plonski ..... 29/846
5,030,134 7/1991 Plosser ..... 439/84
5,042,146 8/1991 Watson ..... 29/845
5,250,759 10/1993 Watson ..... 174/261

*Primary Examiner*—Gary F. Paumen

[57] ABSTRACT

A compression connector for interconnecting microelectronic circuit and cable assemblies, providing shielding and characteristic impedance control, is readily configurable for high-density multi-connector arrays. A first embodiment includes a loop of insulated wire that resides in a magnetically permeable, electrically non-conductive or electrically conductive housing. This wire loop can be affixed to the housing or can be floating and be longitudinally driven. The loop of insulated wire can have a range of insulation removed, from only exposing the extreme end of the wire loop or have the majority of the insulation removed at the loop. A second embodiment includes two contiguous, parallel wire segments that are bonded or welded together, with the contiguous, parallel wire segments used in lieu of the bare-wire loop configuration; this configuration can also be affixed to the housing or be floating and driven.

24 Claims, 7 Drawing Sheets

10
15A
15B
12
17B
17A
17
17C
20
23
25

15A
15B
17B
25
17A
23

15A
15B
30A
30B
30
30C
32
20
35

42A
43
42B
42
40B
40
40A
20
40C
45
42A
48

53
55
42B 42A
42B
53
60A
20B
62B
60B

SECTION I–I 130
135C
135
135A
135B
95A
95B
105
103

95
95C
150

95
95C
155

110A
20A
110B
20B 135A
135B
II
II
95C 95A
135B
135A
95B
SECTION II–II 140
125
140S
142S
135C
105
105
103

95
20
170
175

SLEEVELESS HIGH-DENSITY COMPRESSION CONNECTOR

RELATED APPLICATIONS

This application is a continuation-in-part of copending U.S. Ser. No. 08/752,713 entitled "High-Density Compression Connector" filed in Nov. 19, 1996, now U.S. Pat. No. 5,755,596 issued May 26, 1998.

BACKGROUND OF THE INVENTION

1. Field of the Invention

The present invention relates to the field of high-density electrical connectors, and more particularly, to the class of connectors that provides electrical contact and conduction at one surface by means of surface contact or direct compression.

Whereas patent application Ser. No. 08/752,713 is directed to the placement of a formed loop of wire within an insulating sleeve which is then inserted into an electrically conductive or magnetically permeable housing, the present invention directs the placement of the wire loop directly into the housing without a sleeve. This method uses the existing wire insulation to isolate the inner electrical conductive wire from an electrically conductive housing, or alternatively, have the insulation removed from the entire wire loop or wire segments and placing the wire loop/segments into a non-conductive housing. Each connector can be interconnected with single wire or twisted with another wire using methods described in my U.S. Pat. No. 5,042,146.

2. Description of the Related Art

Because present trends in designing microelectronic devices and circuits are toward increased miniaturization, higher component density and greater number of component leads per piece-part, there is a corresponding need for connectors that can be configured in high-density, large-number arrays. Techniques known in the art for providing high-density interconnections between a monolithic integrated circuit (IC) or multi-chip module (MCM) and a printed wiring board (PWB) include the use of quad flat-packs (QFP) which surrounds an IC or MCM on four sides with wire/lead interconnections or the use of leadless chip-carrier (LCC) which surrounds the four outer sides of an IC/MCM with vertical, flush, interconnecting leads. High-density interconnection techniques wherein connections are arranged in a two-dimensional array located under or near the substrate of an IC/MCM or the base of a PWB include the use of land grid arrays (LGA's), ball grid arrays (BGA's), and pin grid arrays (PGA's). Such arrays can provide short interconnections while permitting a high density of connections. LGA's and BGA's have become popular in part because production equipment used to mount and solder surface-mount devices onto circuit boards can be easily adapted. This ease of manufacture is enhanced by the tendency of array pads on which components will be soldered to self-align by the effects of surface tension caused by the molten solder.

Chip-scale packaging (CSP) is another emerging technique for interfacing an IC to a substrate/circuit board. Still in its infancy, this technology has the potential to provide direct connections between package or circuit board input/output (I/O) pads to IC die or MCM substrates. Typically a CSP package occupies an area that is 20% larger than the size of the die.

Because circuit miniaturization and high-density components entail ever-increasing signal speeds and input/output rates, newly developed devices increasingly require interconnections that can provide adequate shielding to pass low-noise signals or maintain a proper and uniform characteristic impedance to pass signals with fast edges ($\Delta v/\Delta t$) or any signal having a high-frequency harmonic content. In PWB design, characteristic impedance control has been achieved by using strip-line or micro-strip techniques which requires careful control of the size, position and spacing of circuit traces within a dielectric that is spaced away from a ground or reference plane. However, applying strip-line or micro-strip connections to the inner pads of a high-density PWB becomes more difficult as circuit density increases. Also, more layers and increased manufacturing must be used when a device requires numerous, homogenous, shielded, impedance-controlled interconnections. Increased circuit density requires more connections per unit area, especially if numerous ground planes (as required when using micro-strips or strip-lines) are utilized.

U.S. Pat. No. 4,679,321 to J. P. Plonski describes an interconnection board for high frequency signals wherein connectors are in close proximity. The board is constructed having one side provided with a ground plane and the other side provided with terminal pads and interconnection conductors. Holes are drilled through the board at the terminal points. An end of the center conductor of a coaxial cable, stripped of insulation, is inserted through each hole while the conductive shield remains on the other side of the board. Each bare-wire conductor is connected to a pad and the conductors are scribed and bonded into place. The shields can be interconnected by applying a plated copper layer or a conductive encapsulating layer or by reflow soldering.

U.S. Pat. No. 3,114,194 to W. Lohs describes a method of wiring an electrical circuit upon an insulating plate provided with a plurality of holes, whereby wire lengths are kept as short as possible and wires can be crossed. Insulated wire is drawn through a hole in the plate and a loop formed from the wire projecting through the hole. The loop is then crushed to simultaneously anchor the loop into the hole and expose a conductive area.

My prior patent, U.S. Pat. No. 5,042,146 ("146"), discloses a process and apparatus for forming double-helix contact receptacles directly from insulated wire, for interconnecting components independent of printed circuitry. Some of the apparatus disclosed therein, specifically the wire processing mechanism including cutting, stripping, and handling assemblies, is readily adaptable to the present invention which, like the "146" patent, is capable of handling and incorporating both single and twisted-pair insulated wire. Alternatively, coaxial cable can be used with the center conductor in lieu of a single conductor, provided the shield does not contact the center conductor.

My prior patent, U.S. Pat. No. 5,250,759 ("759") entitled "Surface Mount Component Pads", which is incorporated herein by reference in its entirety, discloses a method to form pads for surface-mount electronic components by inserting a stripped portion of insulated wire into an elongated rectangular opening, and anchoring the formed elongated U-shaped loop into place with epoxy or a plug. Although the pads disclosed in the '759 patent can be used with area arrays, their elongated pads will not mesh well geometrically with the square pads normally used in arrays. In addition, due to their shape, elongated pads cannot be disposed sufficiently dense in planar arrays to meet the close proximity requirements of LGA's or BGA's.

OBJECTS OF THE INVENTION

Accordingly, it is a primary object of the present invention to provide a mechanically rugged connector for interconnecting electronic circuit and cable assemblies requiring very high-density interconnections by means of compression of one contact element to another.

Another object of the invention is to provide a connector that is simple to manufacture and repair.

A further object of the invention is to provide a connector that is simple, reliable and easy to use.

Yet another object of the invention is to provide a connector that allows limited control of the characteristic impedance of each signal in a high-density connector array.

Another object of the invention is to provide a connector capable of providing shielding between all elements of the connector array.

Other objects of the invention will become evident when the following description is considered with the accompanying drawing figures. In the figures and description, numerals indicate the various features of the invention, like numerals referring to like figures throughout both the drawings and description.

SUMMARY OF THE INVENTION

These and other objects are achieved by the present invention, a compression connector assembly configured in a multi-unit high-density array, for interconnecting very high density microelectronic circuits, devices, and other connectors. High density connectors are fabricated by inserting tightly formed wire loops or wire segments that are constructed from portions of insulated wire into holes of a housing. In one embodiment, the connector is constructed from a continuous length of wire formed into a loop. In another embodiment the connector is constructed from individual segments of wire and the segments bonded soldered together.

A more complete understanding of the present invention and other objects, aspects and advantages thereof will be gained from a consideration of the following description of the preferred embodiments read in conjunction with the accompanying drawings provided herein.

References to the term "juxtaposed connectors" refers to the collocation of connectors in a side-by-side manner, as contrasting to opposing connectors which are facing each other to connect to each other. Also, references to insulated wire apply to any form of electrically conductive wire that is covered with an electrically non-conductive material, where the electrically non-conductive material is thin (as applied with magnet wire) or thick (as applied in high-voltage applications.)

DESCRIPTION OF THE PREFERRED EMBODIMENTS

I. INTRODUCTION

Figures 1A, 1B, 2, 3, 4A, 4B, 5:
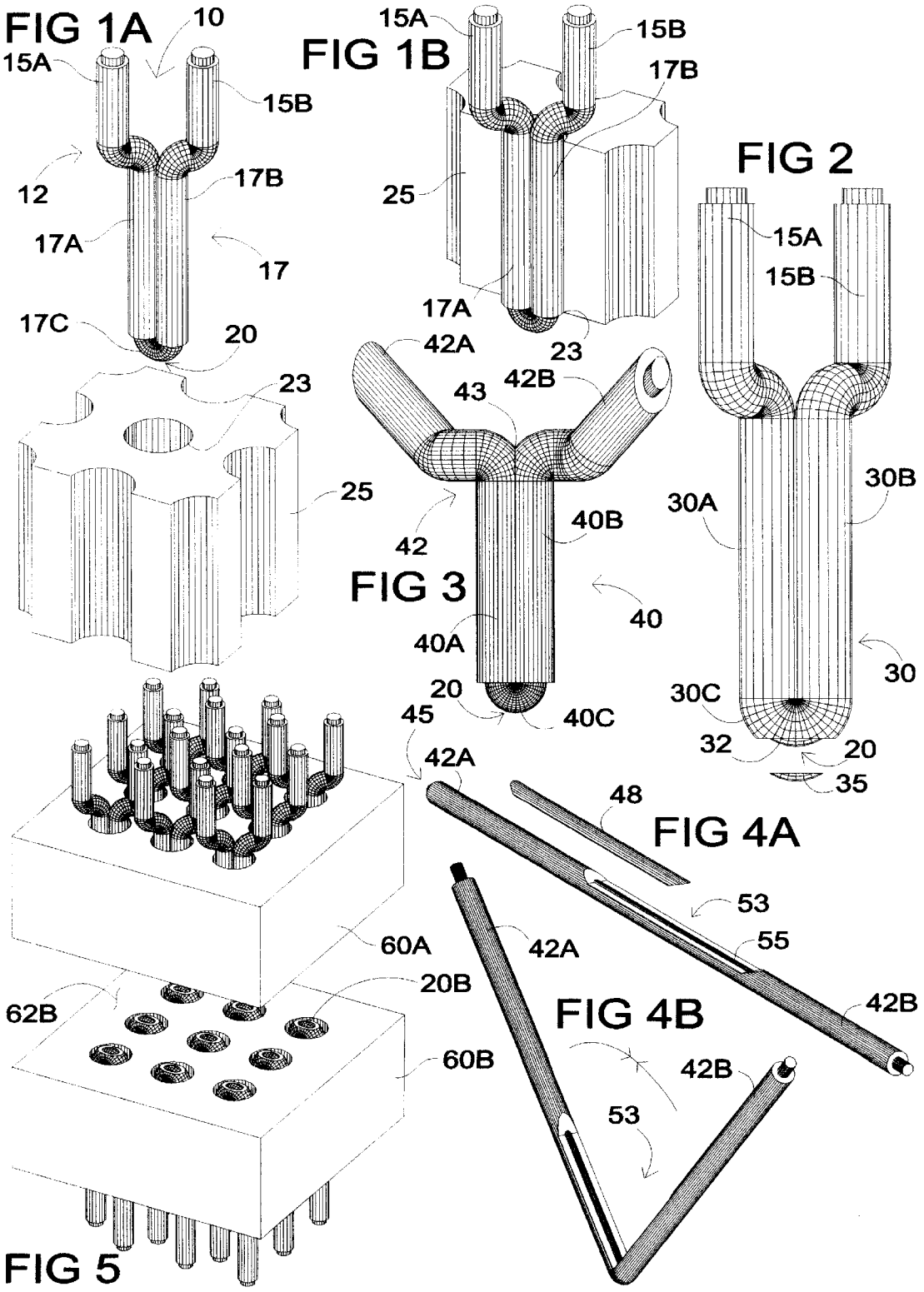
FIG. 1A is an exploded perspective view of the preferred connector assembly that uses the wire-loop end as an electrical contact point, where a representative wire loop is elevated above a housing having cylindrical receptacles.
FIG. 1B shows a partial housing and receptacle accommodating the wire loop of FIG. 1A.
FIG. 2 is a side view of a modified wire loop where only the extreme end of the wire loop is removed of insulation.
FIG. 3 is a side view of a modified wire loop that has the insulation removed at the fold (center) of a wire loop.
FIG. 4A is the first of two figures showing a perspective view for the preparation of the wire prior to forming the wire loop of FIG. 3.
FIG. 4B is a perspective view of the bending of the wire of FIG. 4A to form the wire loop of FIG. 3.
FIG. 5 is a perspective view of two separated arrays of opposing mating connectors.

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims.

The embodiments as described herein define methods to manufacture high-density electrical contact elements by using insulated wire whose stripped portions serve as contact elements and placing these contact elements into receptacles of a supporting housing. The wire gauge and insulation of the connection thickness can vary to accommodate the electrical requirements of each connection. The wire is not restricted to solid type wiring but also can include stranded wiring, provided that care is given to prevent the fraying of the ends that can in turn create unwanted electrical contact to the ground plane or adjacent connectors.

II. FIRST PREFERRED EMBODIMENT

Compression connector assembly 10 of FIG. 1 shows an exploded view of the preferred mode of the present invention. Compression connector assembly 10 includes a section of insulated interconnect wire 12 having opposed insulated feed wires 15A and 15B and a U-shaped loop of wire 17 comprised of collocated wire segments 17A and 17B. Insulated wire segments 17A and 17B are connected by a bared 180 degree electrically conductive wire-loop end 17C removed of insulation and having an electrical contact area at 20. Electrical contact with an opposing contact element occurs at area 20. A generally cylindrical receptacle 23 residing in housing 25 accommodates formed wire-loop 17. Housing 25 is preferably electrically conductive and magnetically permeable in order to provide adequate shielding against, respectively, E (electrostatic) fields and H (magnetic) fields. Housing 25 can alternatively be construction of an insulating material or one having a selected dielectric constant. As shown in FIG. 1B wire segments 17A, 17B are closely received and secured within one of a plurality of generally cylindrical, closely proximate receptacle 23 of housing 25. The insulation covering wire segments 17A, 17B prevent any electrical conduction between the internal conductive wire (not shown) and conductive housing 25. Either sides of feed wires 15A or 15B can continue to the next connector or be severed to terminate the connection or string of connections.

As an alternative to exposing the entire center conductor on loop 17C, varying degrees of insulation can be removed to expose a varying amount of center conductor. In practice, maximizing insulation coverage increases the protection of the loop-end. FIG. 2 shows a modified wire loop 30 consisting of insulated wire segments 30A, 30B and a 180 degree wire-loop end 30C, where only the extreme end of wire loop 30C is removed of insulation to expose electrical contact 20 on the surface of conductive wire-loop 32C. In order to increase conductivity and to prevent oxidation of the contact area, a plating 35 consisting of a noble metal can optionally be attached to electrical contact 20.

U-shaped wire loop 40 of FIG. 3 is modified from U-shaped wire loop 17 of FIG. 1A whereas a portion of inner insulation of segments 40A, 40B between feed wires 42A, 42B has been removed at seam 43. Without the insulation at seam 43 the internal conductive wire segments (not shown) are touching along the common longitudinal length of wire loop 40. By eliminating the two thicknesses of the central insulation from the inner insulation of segments 40A, 40B, the area (footprint) of the connector is reduced. Although wire-loop end 40C is shown completely removed of insulation, a small portion of insulation may be removed to expose only the electrical contact at 20, similar to wire-loop end 30C of FIG. 2. In addition, plating 35 of FIG. 2 can cover electrical contact 20 of wire-loop end 40C to enhance conduction and provide protection from oxidation of the contact area.

FIGS. 4A and 4B show the formation of wire loop 40 from insulated wire 45. A section of insulation 48 is removed at area 53 to expose the surface of inner conductive wire 55. When wire segments 42A, 42B are bent together, as shown in FIG. 4B, area 53 folds into seam 43 of FIG. 3.

FIG. 5 shows two separated 3×3 opposing compression connector arrays 60A and 60B that use an opposing array of wire loop connectors 30 of FIG. 2. In this particular arrangement, the array electrical contact areas 20A (not shown) and 20B are level to planes 62A (not shown) and 62B of, respectively, housing 60A and 60B.

Figure 6:
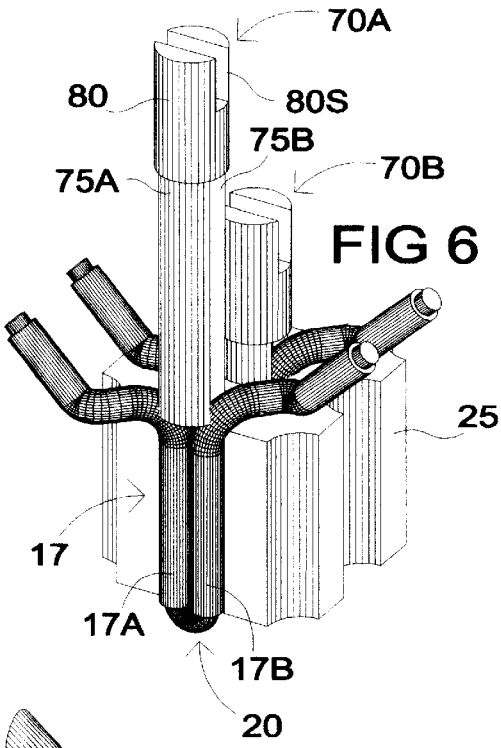
FIG. 6 is a partial view of a wire loop with fingers that fit between and longitudinally moves the wire loop.

As an alternative to securing wire loops 17, 30, or 40 within receptacle 23 of housing 25, the wire loops can float within receptacle 23. FIG. 6 shows two juxtaposed wire loop connectors 70A and 70B within housing 25. A portion of the forward housing is removed in FIG. 6 to show wire segment 17A, 17B. Wire segments 17A, 17B are driven forward by fingers 75A, 75B in order to press electrical contact 20 against the opposing contact element. Forward connector 70A also has fingers 75A, 75B elevated above the wire loop 17 while the fingers for the rear connector 70B are situated in its working position. Fingers 75A, 75B are centrally positioned between the two wire segments 17A, 17B to provide sufficient mutual contact to allow longitudinal positional control of wire loop 17. Fingers 75A, 75B are connected to and driven by a shoulder 80 that is itself driven by a mechanical means.

Figure 7:
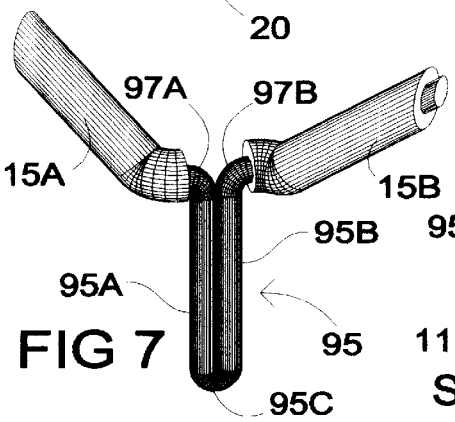
FIG. 7 is an alternative wire loop whose loop and wire segments are totally removed of insulation.

FIG. 7 shows a modified wire loop 95 where insulation is completely removed on wire loop 95 between insulated feed wire 15A, 15B. Wire loop 95 consists of bare-wire segments 95A, 95B located between bare-wire loop 95C. The boundary for the insulation for wire loop 95 normally transitions in the vicinity of the 90 degree elbows 97A, 97B. Although the insulation on wire segments 95A, 95B are shown completely removed in FIG. 7, the insulation can be removed in varying degrees to accommodate the electrical and mechanical dimensional requirements of the connector.

Figure 8:
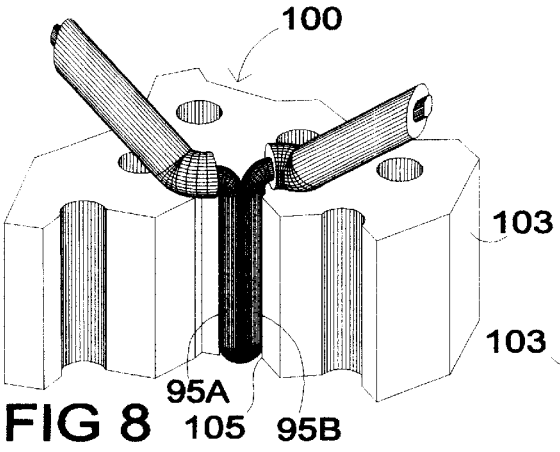
FIG. 8 is the wire loop of FIG. 7 secured in a electrically non-conductive housing.

FIG. 8 shows connector 100 comprised of wire loop 95 of FIG. 7 that is secured into a cylindrical receptacle 105 of an electrically non-conductive housing 103. The forward portion of electrically non-conductive housing 103 is partially removed in FIG. 8 in order to reveal the wire loop segments 95A, 95B. Methods of securing wire loop 95 into receptacle 105 can include epoxy, a compression/friction fit, or a plug. Housing 103 can be constructed to be magnetically permeable while also being electrically non-conductive by emulsifying particles of a ferrous material within a electrically non-conductive medium such as a ceramic, plastic, or epoxy. Encasing the receptacle within a magnetically permeable housing provides shielding for adjacent wire loops against magnetic H-fields while providing resistance to electrical current.

Figure 9A:
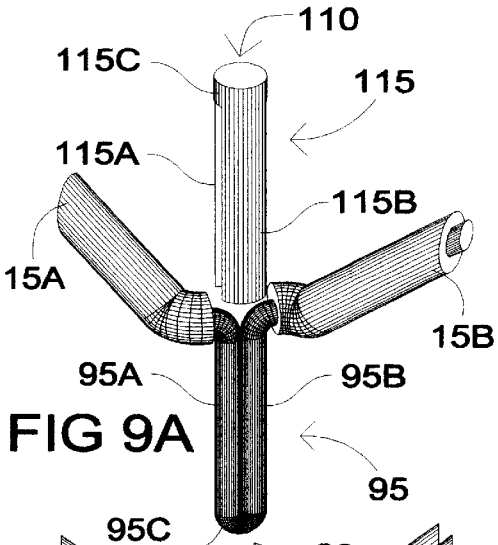
FIG. 9A is a partially exploded perspective view of a bare-wire loop and fingers that fit between the wire loop.

FIGS. 9A, 9B, 9C, and 9D show an alternative compression connector 110 where wire loop 95 is floating and longitudinally driven within an insulating housing. Connector 110 is shown in FIG. 9A exploded away from finger assembly 115. Finger assembly 115 includes fingers 115A, 115B connected by a bridge 115C. Fingers 75A, 75B of FIG. 6 and fingers 115A, 115B of FIG. 9A serve identical functions by driving the electrical contact 20 forward. Finger assembly 115 can be comprised of any resilient plastic or metallic material. As with loop 17 of FIG. 6 the longitudinal position of electrical contact 20 on loop-end 95C is driven forward by fingers 115A, 115B.

Figure 9B:
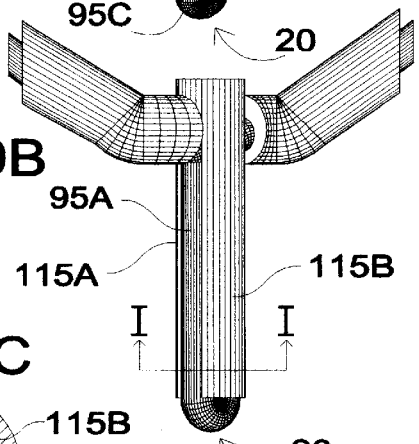
FIG. 9B is a side view of the assembled FIG. 9A connector.

As best shown in FIG. 9B the working position of fingers 115A, 115B are situated between wire loop segments 95A, 95B (not shown) and the electrical contact 20 extends beyond the end of fingers 115A, 115B. The positioning of fingers 115A, 115B and parallel wire segments 95A, 95B are shown in section view A—A of FIG. 9C. The cross section of wire segments 115A, 115B and fingers 95A, 95B closely conforms into generally cylindrical receptacle 60.

Figure 9C:
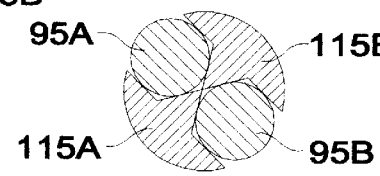
FIG. 9C is a cross-sectional view taken along line A—A of FIG. 9B.
Figure 9D:
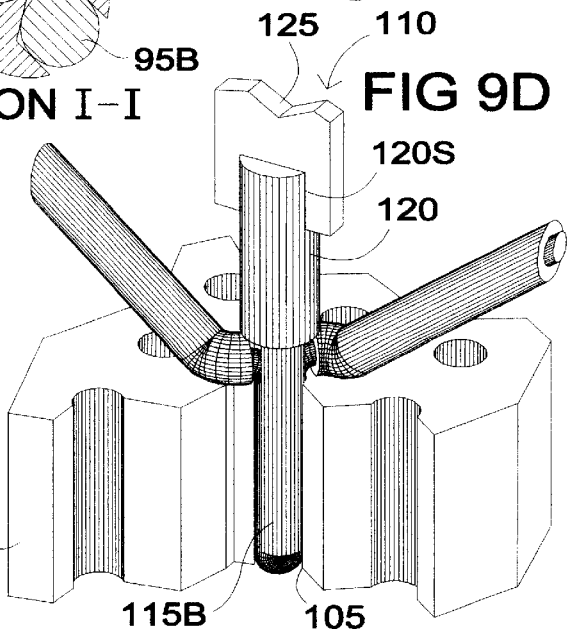
FIG. 9D is an assembled partial view of a complete the FIG. 2A wire loop, fingers and a shoulder assembly and an attached longitudinally movable arm.

FIG. 9D shows the assembled connector assembly 110, with finger 115A (not shown) and finger 115B collocated within a generally cylindrical receptacle 105 of an insulating housing 103. Drive for fingers 115A (not shown) and 115B is through an attached generally cylindrical insulating shoulder 120. Shoulder 120 has an upper end slot 120S to accommodate a rigid, longitudinally movable arm 125. Referring to FIGS. 9B and 9D, finger assembly 115, wire loop 95 and shoulder assembly 50 move together and are longitudinally driven within receptacle 105 by movable arm 125.

Figures 10A, 10B, 10C, 10D, 11, 12, 13, 14:
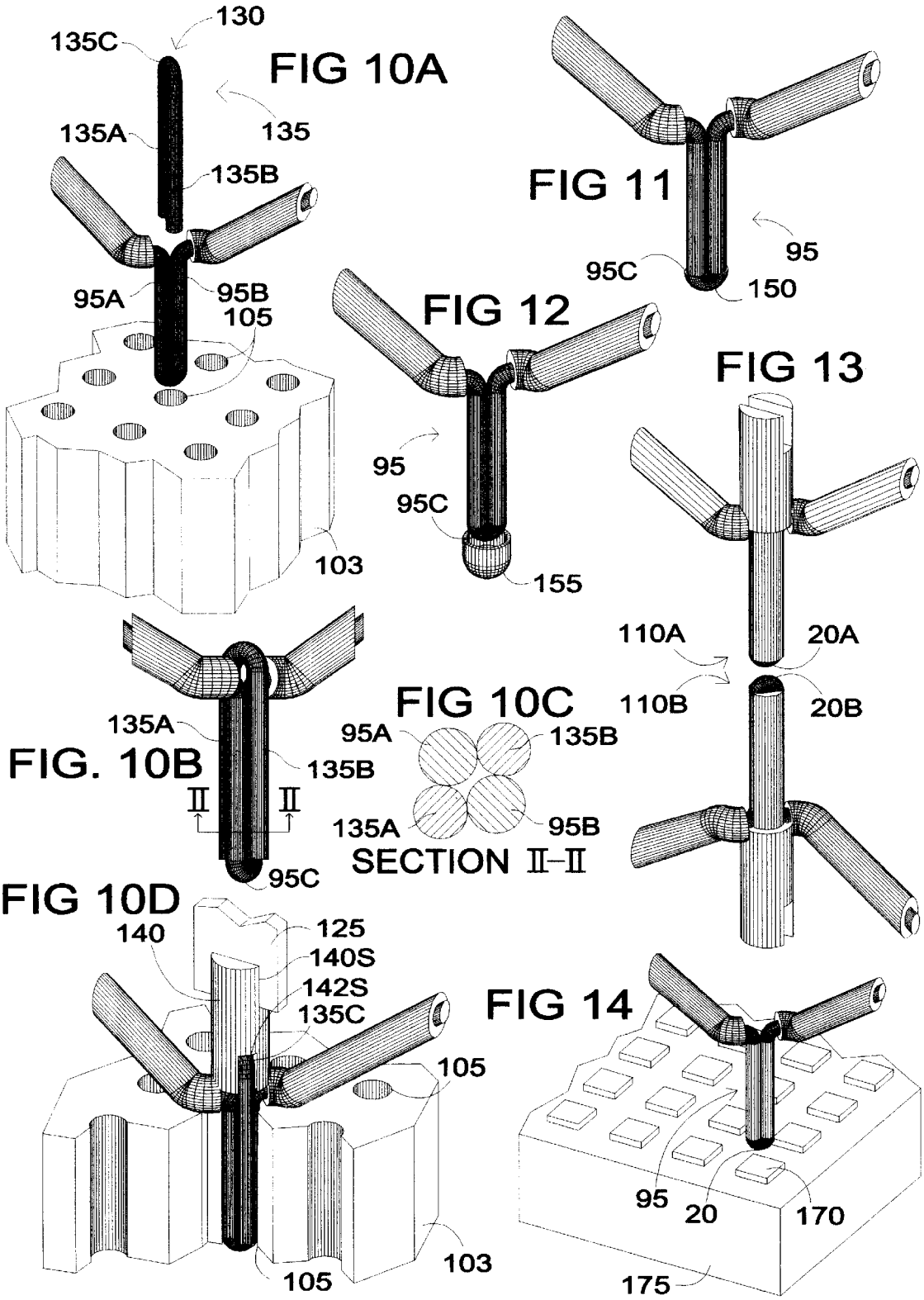
FIG. 10A is an exploded perspective view of an alternative to FIG. 9A, where a U-shaped clamp replaces the fingers of FIG. 9A.
FIG. 10B is a side view of the FIG. 10A connector assembly with the U-shaped clamp oriented on the wire loop.
FIG. 10C is a cross-sectional view taken along line B—B of FIG. 10B.
FIG. 10D is an assembled partial view of the FIG. 10A wire loop, fingers-and-shoulder assembly, and an attached longitudinally movable arm.
FIG. 11 is a perspective view of a wire-loop end having a plated surface.
FIG. 12 is an exploded perspective view of an electrically conductive cap that fits over the wire loop loop-end.
FIG. 13 is a perspective view of two separated mating connectors of FIG. 9B.
FIG. 14 is a perspective view showing a connector of FIG. 9B positioned above a pad of a pad-arrayed electronic device.

FIGs. 10A, 10B, 10C, and 10D show a modified finger and shoulder assembly to replace the finger and shoulder assembly of FIGS. 9A, 9B, 9C and. 9D. FIG. 10A shows an exploded view of alternative compression connector assembly 130 which includes wire segments 95A, 95B disposed in a generally cylindrically receptacle 105 of housing 103. In connector 130, finger assembly 115 of FIG. 9A is replaced by a U-shaped wire finger assembly 135 constructed from a rigid piece of wire and composed of arcuate segment 135C disposed between generally parallel segments 135A, 135B. As best shown in FIG. 10B, loop-end 95C protrudes beyond the wire fingers 135A, 135B. Generally cylindrical shoulder 140 having slot 140S replaces shoulder 120 and slot 120S of FIG. 9D. Arcuate segment 135C resides within slot 142S of shoulder 140. Longitudinally movable arm 125 resides within upper end slot 140S. Both parallel segments 135A, 135B and segments 95A, 95B are collocated within the confines of generally circular receptacle 105. Preferably, wire finger 135 is fabricated from stainless steel or beryllium copper. Typically, shoulder 140 is fabricated from an electrically non-conductive material.

FIG. 11 shows the wire-loop end 95C of wire loop 95 plated with a layer 150 of noble metal, such as gold, to increase electrical conduction and protect the electrical contact area from oxidation. As shown in FIG. 12, an alternative to plating is fitting a metallic cap 155 over the loop-end 95C. If sufficiently elongated, cap 155 can also increase the rigidity of wire loop 95.

FIG. 13 shows two separated opposing compression connector assemblies 110A and 110B each including, respectively, an upper electrical contact area 20A and a lower electrical contact area 20B. In this figure for clarity, housing 103 for both opposed assemblies are not shown.

FIG. 14 shows how a wire loop 95 of FIG. 7 is positioned above one of a multiplicity of interconnecting pads 170 of a microelectronic device 175. For clarity, only a single one-to-one relationship between a loop and a pad is shown and the housing is not shown. In a fully configured system each pad is connected to a corresponding loop. Contact between loop-end 20 and pad 170 is achieved by vertical movement of the loop 95 or device 175 until the loop-end is compressed against the pad.

Figure 15A:
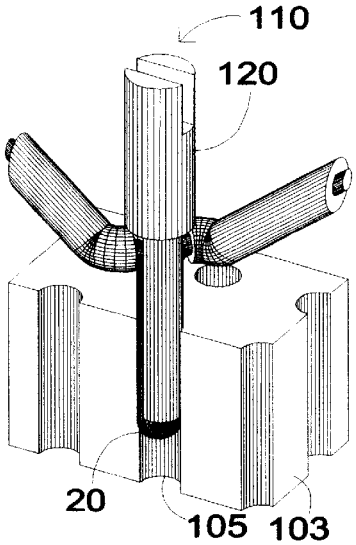
FIG. 15A is a partial sectional view of FIG. 6, FIG. 9D or FIG. 10D wherein the wire loop is partially inserted into the housing.
Figure 15B:
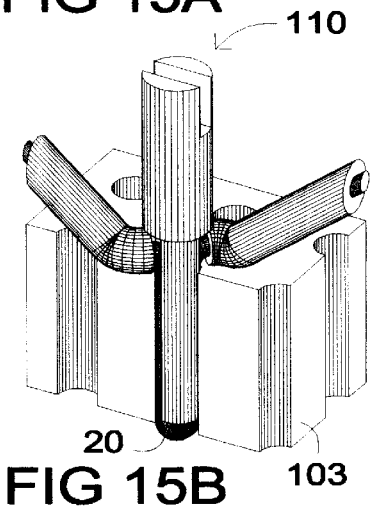
FIG. 15B is a partial sectional view of FIG. 6, FIG. 9D or FIG. 10D wherein the wire loop is fully inserted into the housing.

FIG. 15A and 15B shows the longitudinal positioning of connector assembly 110 where the movable arm 125 (not shown) drives shoulder 120 into and out of housing receptacle 105. FIG. 15A shows connector assembly 110 slightly elevated to retract the wire loop-end within housing receptacle 105. FIG. 15B shows connector assembly 110 fully extended to push electrical contact 20 slightly beyond the lower plane of housing 103.

Figure 16:
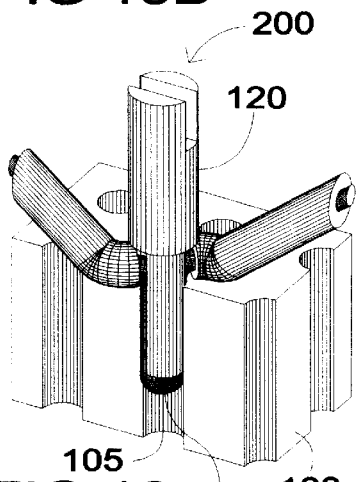
FIG. 16 is a partial sectional view of a shortened wire loop assembly, where the wire-loop end only partially fills the cavity of the housing receptacle.

FIG. 16 shows a modified connector assembly 200 in which the working position of the electrical contact 20 occurs within the confines of receptacle 105. By having the male contact pin inserted into the housing receptacle, the male pin is restrained from lateral movement during electrical contact.

Figure 17A:
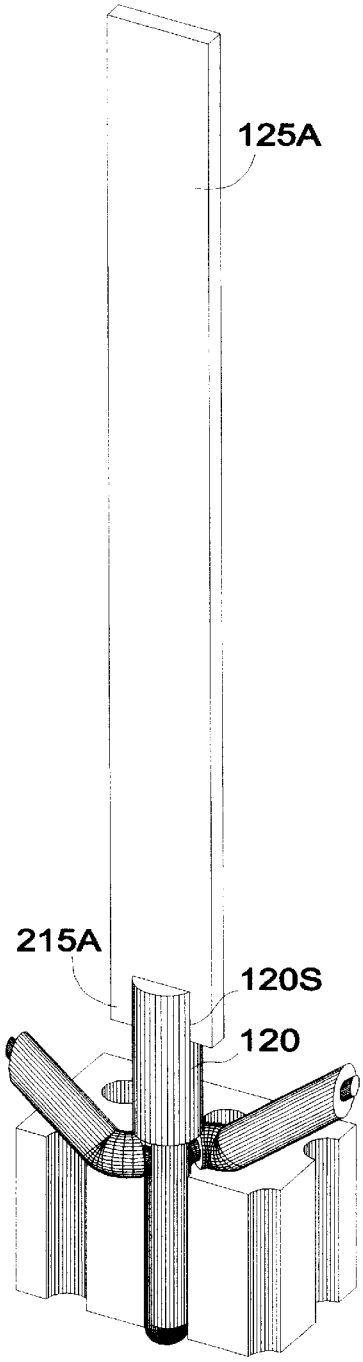
FIG. 17A is a partial view of a first type of longitudinally movable arm connected to the FIG. 9D shoulder.
Figure 17B:
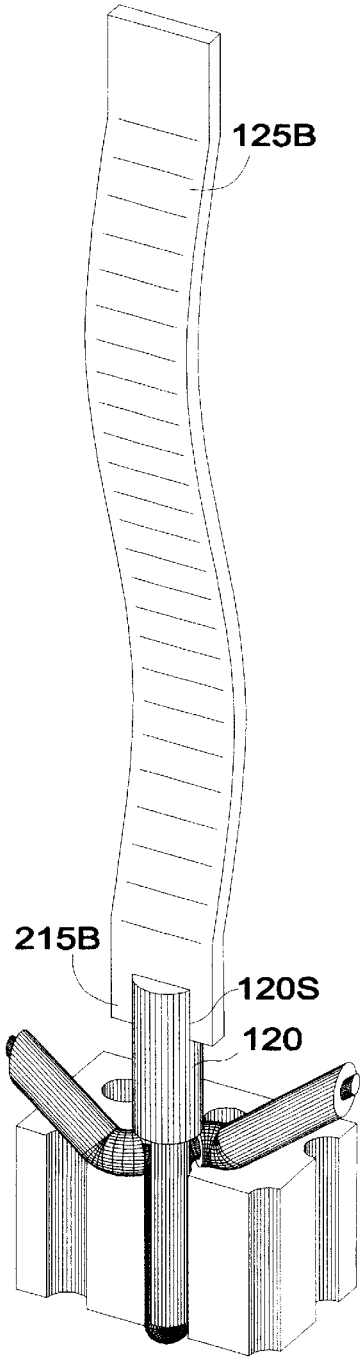
FIG. 17B is a partial view of a second type of longitudinally movable arm connected to the FIG. 9D shoulder.

FIG. 17A shows a first type of rigid arm 125A whose lower end 215A is closely received within slot 120S of shoulder 120. Preferably, arm 125A is fabricated from a rigid metallic alloy such as spring steel or beryllium copper. Such a material provides the rigidity required of the arm and enhances shielding between neighboring rows of interconnect wiring. When arm 125A is metallic, the shoulder 120 must be electrically non-conductive so that signals will be electrically isolated from one another. Alternatively, arm 125A can be fabricated from a rigid non-conductive material such as a plastic. FIG. 17B shows a second type of arm 125B having an undulating form which acts to increase arm resilience and whose lower end 215B is also closely received within slot 120S of shoulder 120. Arm 125B can also be fabricated from either a metallic or a non-metallic material.

Figure 18:
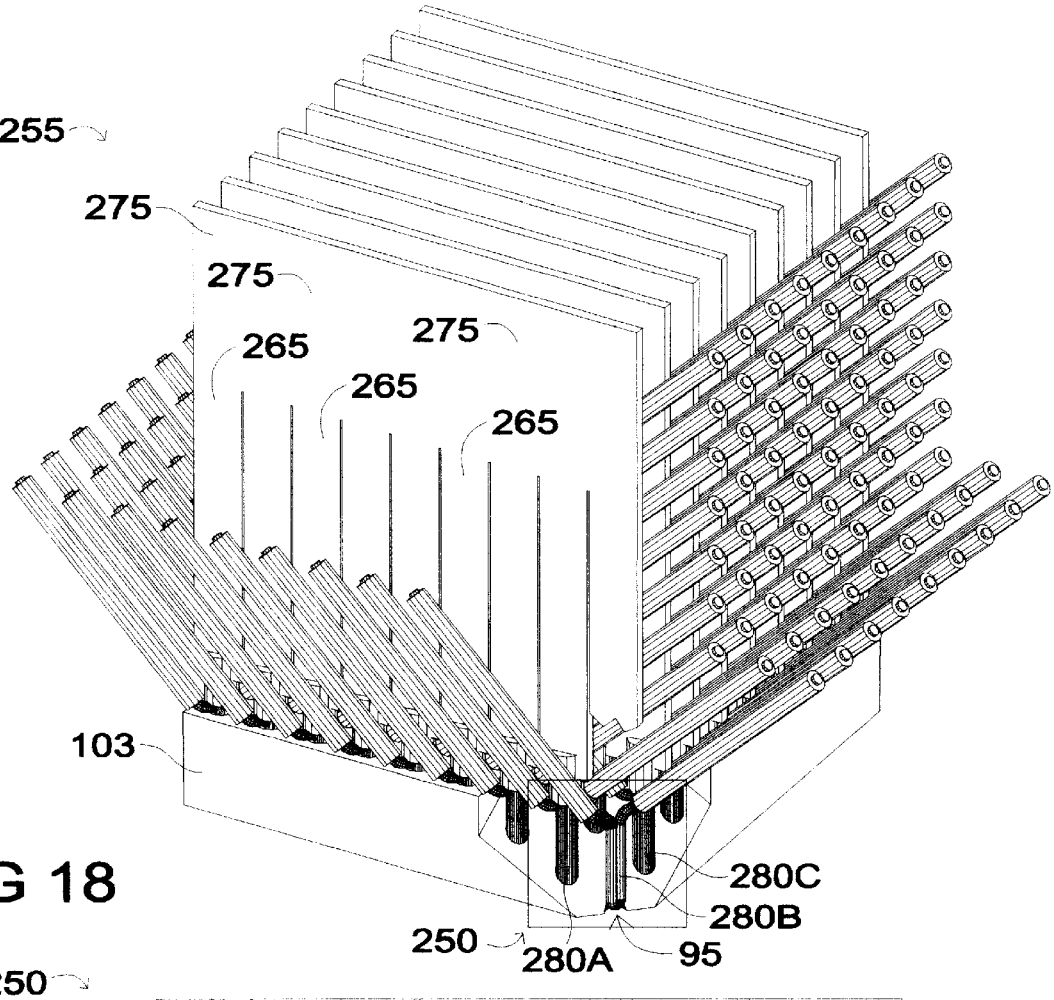
FIG. 18 is a combined perspective and partial sectional view of a multiplicity of first embodiment connector assemblies disposed in an arrayed module including a corresponding multiplicity of longitudinally movable arms, interconnect wiring, and a base.
Figure 19:
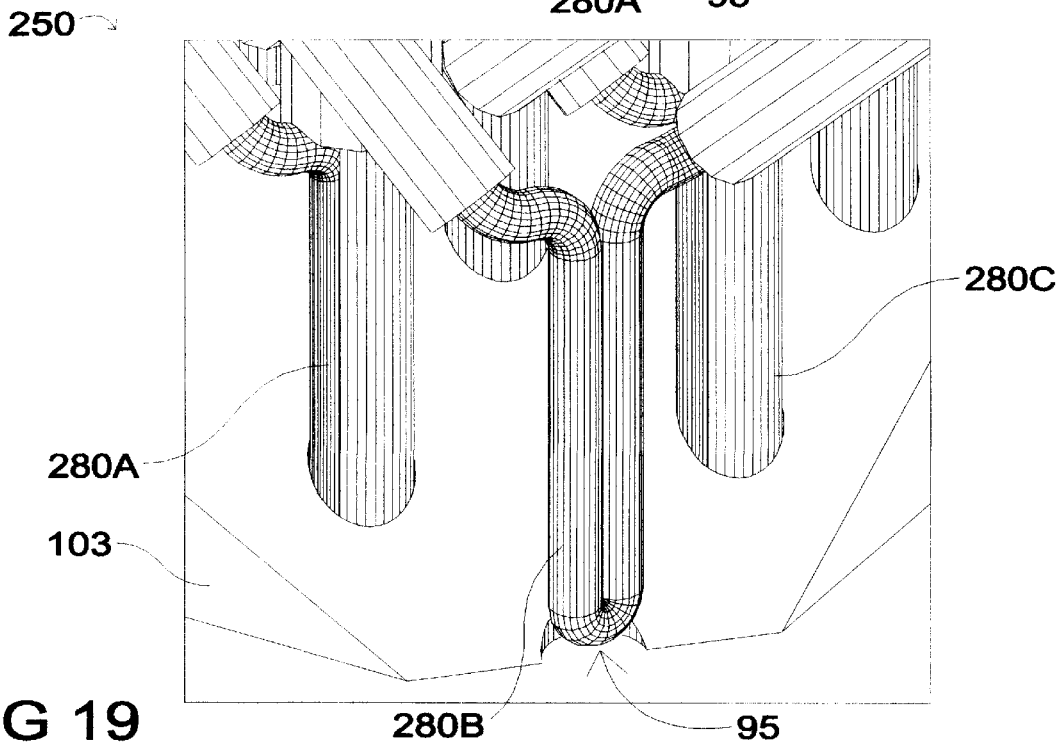
FIG. 19 is an enlarged view of the FIG. 18 detail region.

Referring to FIG. 18 and a detail view 250 from FIG. 18 shown in FIG. 19, an array module 255 includes a plurality of connector assemblies 110. A section of the forward housing 103 is removed in detail view 250 to reveal a portion of the forward connectors 280A, 280B and 280C. Wire loop 280B is shown without fingers in order to better see wire loop 95. The shoulder of each assembly is attached to an individual lower arm 265 having an independent, discrete drive, and each arm 265 is attached to an upper arm 275 so that each connector is provided with proper contact pressure.

Figures 20, 21:
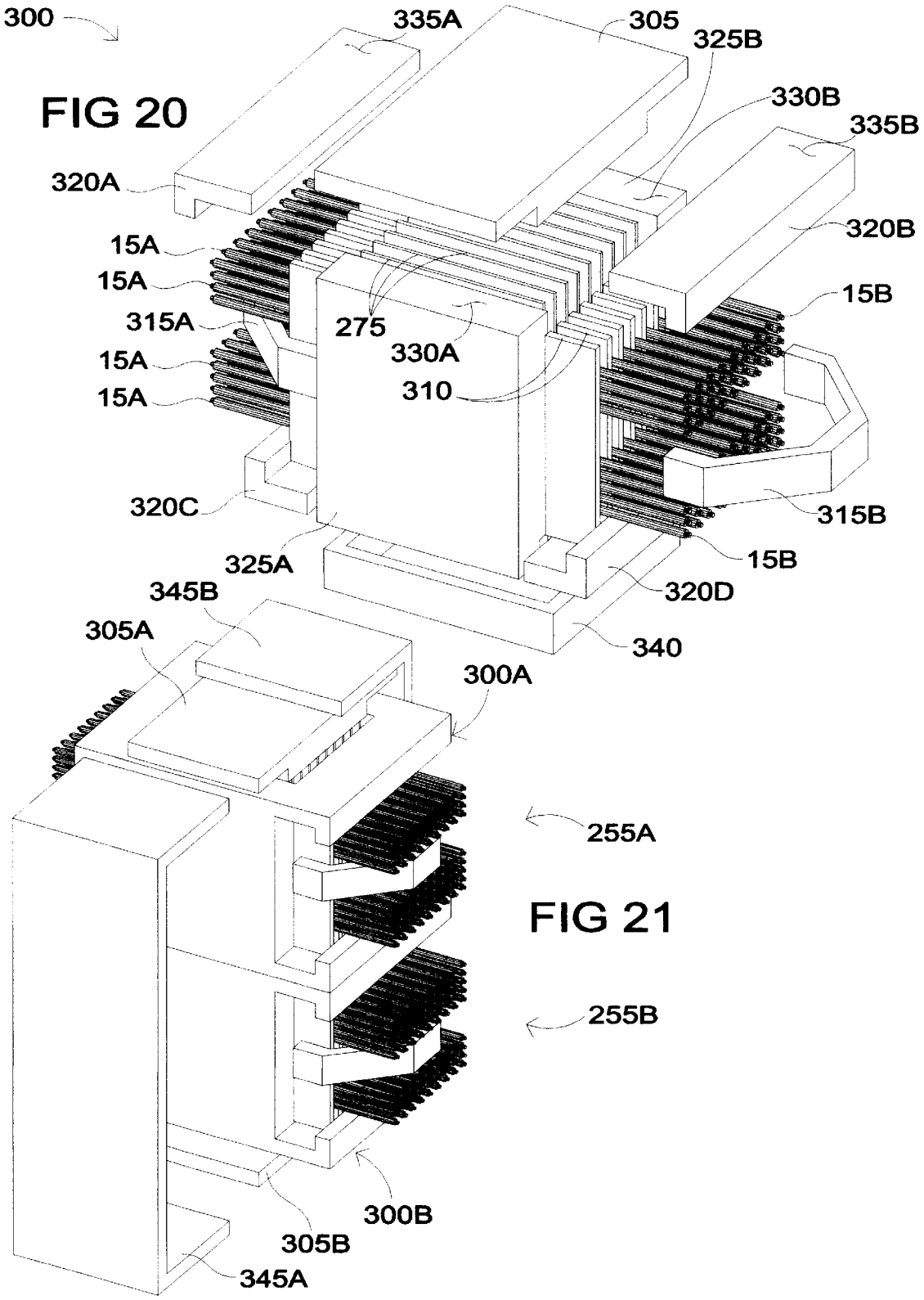
FIG. 20 is an exploded perspective view of structural components of a housing enclosing and supporting the FIG. 18 module.
FIG. 21 is a perspective view of two opposing FIG. 20 modules and housings.

FIG. 20 shows an array module housing 300 enclosing and supporting the module 255 of FIG. 18. Housing 300 includes a pressure plate 305 which presses against the upper arm 275 to drive the array of loop-end contacts 95C (not shown). A plurality of stress-relief plates 310, secured by clamps 315A, 315B sandwiches and secures the array of interconnect wires 15A, 15B. Housing 300 further includes stress-relief plate retainers 320A, 320B, 320C, 320D holding the stress-relief plates 310 in place, opposed side plates 325A, 325B having an upper surface 330A, 330B, respectively, flush with and bonded to surface 335A, 335B, respectively, of retainers 320A and 320B, and a guide 340 which fits housing 103 (not shown) to align each connector assembly with the other connector assembly or electronic component.

FIG. 21 shows two opposing array modules 255A and 255B enclosed, respectively, by module housings 300A, 300B with a plurality of signal/wire contact elements between the two cable assemblies 342A (not shown), 342B (not shown). Assemblies 320A, 320B, 320C, 320D, 325A, and 325B are unified from FIG. 20 and pressure plates 305A and 305B are positioned to apply pressure on the connector elements via arms 275. One possible means of applying pressure to the opposed pressure plates 305A and 305B is by use of opposed clamp fixtures 345A (shown laterally displaced for viewing) and 345B. Assemblies 320A, 320B, 330A, and 330B are preferably attached by fasteners or epoxy, with the upper surfaces 330A, 330B, 335A and 335B at the same plane.

It will be apparent to those skilled in the electronic packaging and connector arts that other array module and housing configurations can be devised which drive or apply pressure to the arms 275, provide strain relief for the interconnect wiring, and ensure contact alignment between opposing assemblies.

III. SECOND PREFERRED EMBODIMENT

Figure 22:
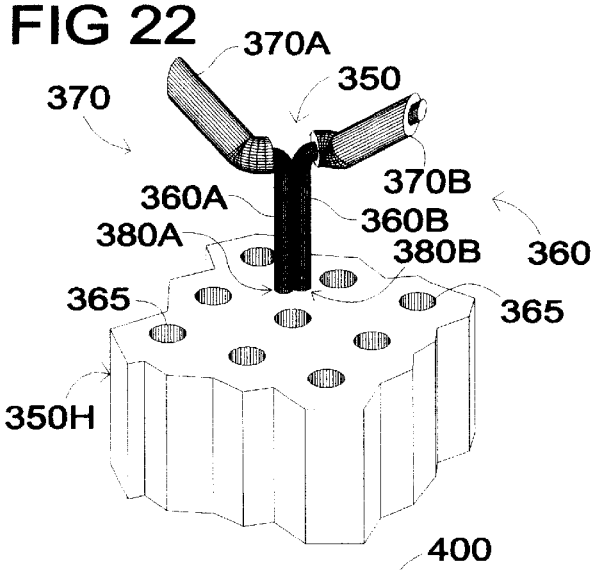
FIG. 22 is a exploded perspective view of a second embodiment consisting of two adjacent, parallel wires bonded together and situated above a multi-unit conductive housing.

Referring to FIG. 22, a second embodiment of a multi-unit connector and housing assembly 350 includes a plurality of wire segments 360 and a housing 350H constructed from an electrically insulating material that has a plurality of generally cylindrical, closely proximate receptacles 365. Bare wire segments 360 constructed from insulated wire 370A and 370B consist of parallel bare-wire segments 360A and 360B that terminate at electrical contact ends 380A, 380B. Separate wire segments 360A, 360B replace the continuous length wire loop, as utilized in wire loop 95 of FIG. 7 that includes bare-wire segments 95A, 95B, and loop-end 95C. Preferably, segments 360A, 360B are soldered or welded together to provide an integral, unified assembly.

Figure 23:
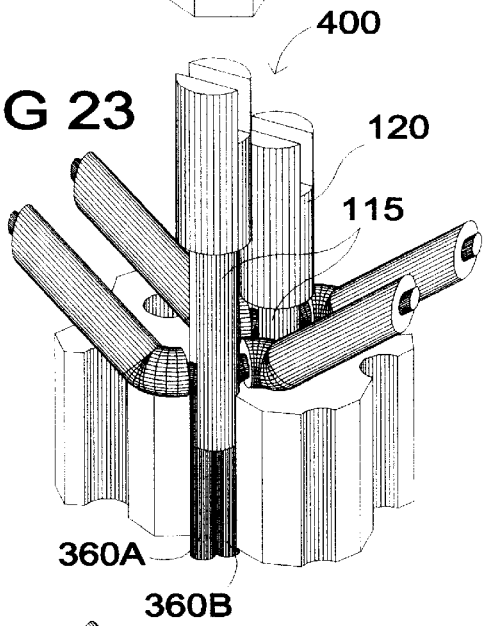
FIG. 23 is a partial view of two adjacent connectors of FIG. 22, with the forward arm and shoulder raised to show the positioned wire segments.

FIG. 23 shows a partially exploded juxtaposed compression connectors 400 consisting of the bare wire segments 360A, 360B. An arm assembly 125A, 125B (both not shown) as used in the first embodiment in FIG. 17A and 17B can be applied in connector 400 to affect vertical movement of wire segments 360A, 360B via shoulder 120 and fingers 115.

Figure 24:
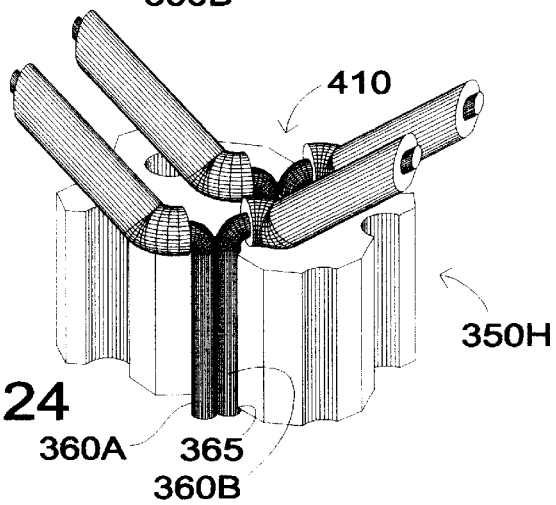
FIG. 24 is a partial view of two juxtaposed connectors of FIG. 22, where the wire segments are secured to the inner wall of the cavity of the housing.

FIG. 24 shows connector 410 where wire segments 360A, 360B are secured to the inner receptacle wall 365 of housing 350H, where the means to secure connector 360 into receptacle 365 can include epoxy, compression/press fit or plug.

Figure 25:
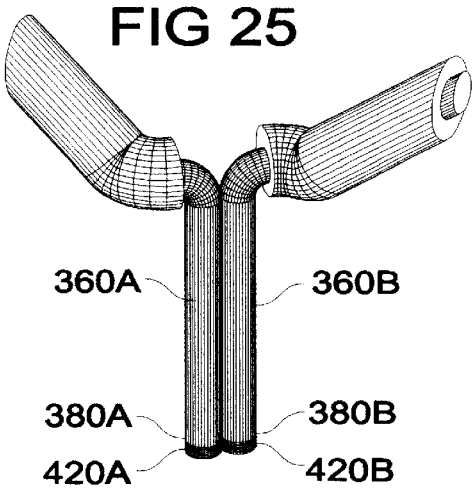
FIG. 25 is a side view of a second embodiment connector having a plated surfaces at the segment ends.
Figure 26:
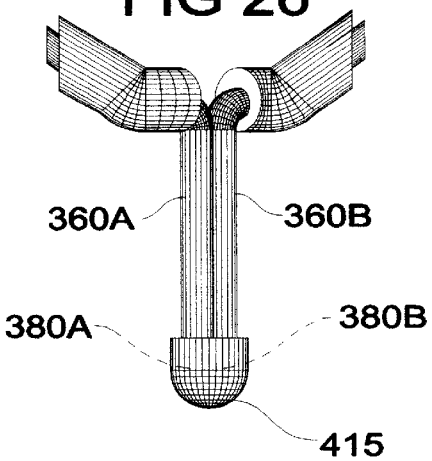
FIG. 26 is a side view of a second embodiment connector with the wire segment loop-ends fitted with an electrically conductive cap.

Many other enhancements and modifications as defined with the first embodiment can apply to the second embodiment. FIG. 25 shows the segments 360A, 360B having a plating of noble metal 420A, 420B to the electrical contact ends 380A, 380B to prevent oxidization of the electrical contact point. FIG. 26 shows the wire segment ends of 380A, 380B fitted with a cap 415, where the cap not only serves as a protective end but can also improve the mechanical binding of wire segments 360A, 360B; if sufficiently elongated cap 415 can enhance the rigidness of the wire loop.

Figure 27:
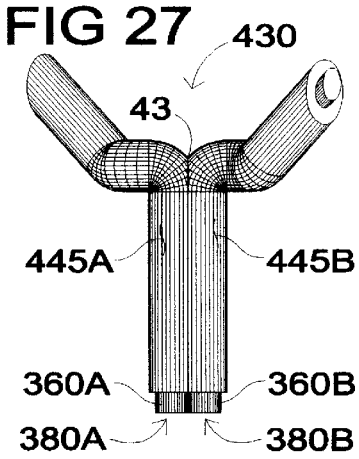
FIG. 27 is a side view of an alternative wire segment-pair of the second embodiment where the wire insulation remains over the majority of the connector.

FIG. 27 shows a connector 430 of two adjacent segments of conductive wire 360A, 360B and surrounded by modified insulation segments 445A, 445B. This arrangement is similar to the wire loop 40 of FIG. 3 where seam 43 occurs at the boundary between the wire segments of conductive wires 360A, 360B. Electrical contact to an opposing electrical contact occurs at the end of conductive wires 360A, 360B at wire segment ends 380A, 380B.

In summary, each embodiment have common traits for mounting and operation. They can have the wire loop or segments secured to the housing or alternatively float within the housing. Securing methods include epoxy, plug, or compressed (e.g. press fit). In the floating loop configuration, the wire loop is closely received, held and driven by fingers. Positioning the wire loop within the housing cavity can vary to allow the contact point to either be within the housing, above the housing, or at the plane of the housing. The wire segments, wire loop, or segment ends on both embodiments can have a varying amount of insulation removed to accommodate the requirements of the connection. In addition the electrical contact point at the end of the wire loop or wire segments can use a noble metal to enhance electrical conduction and prevent oxidation of the contact point.

In each embodiment, different wire gauges and wire insulation can be used to meet the electrical and mechanical requirements of the connection. Decreasing the wire diameter increases the density of the connector array at the cost of higher resistance, inductance and less current carrying capability. Increasing the size of the wire diameter increases electrical current capability with less inductance at the cost of increasing the size (or footprint) of the connector. Materials having a specific dielectric can provide limited control for capacitance, voltage rating, or electrostatic properties. In each embodiment, the exposed portion at the end of the wire loop or wire segment serves as an electrical contact point to any other contact point, such as a pin or pad of an electronic component or connector.

Both embodiments can be manufactured using an environmentally-safe process as no chemicals are required to etch or electroplate electrical junctions. Pieces of removed insulation are the only byproduct.

What is claimed is:

1. An electrical contact-type connector assembly comprising:

a plurality of pairs of contiguous first and second generally parallel insulated wire segments of a common predetermined length having an exposed area, where a portion of each exposed area comprises an electrical contact element;

a plurality of receptacles in a housing, each receptacle having a generally cylindrical surface with opposed upper and lower open ends, each pair of wire segments being disposed within one of said receptacles with said electrical contact elements located at the lower end of the receptacle; and means for rigidly maintaining said pairs of wire segments within said receptacles in the housing.

2. The connector assembly of claim 1, wherein said wire segments are electrically connected through said exposed area.

3. The connector assembly of claim 1, wherein said exposed area includes the length of the wire segments.

4. The connector assembly of claim 1, wherein said housing is electrically conductive.

5. The connector assembly of claim 1, wherein said housing is electrically non-conductive.

6. The connector assembly of claim 1, wherein said housing is magnetic permeable.

7. The connector of claim 1, wherein said contact element is plated with a noble metal.

8. An electrical contact-type connector assembly comprising:

a plurality of loops of insulated wire, each loop comprising contiguous first and second generally parallel wire segments of a common predetermined length with a loop end having an exposed area, where a portion of each exposed area comprises an electrical contact element;

a plurality of receptacles in a housing, each receptacle having a generally cylindrical surface with opposed upper and lower open ends, each wire loop being disposed within one of said receptacles with said electrical contact elements located at the lower end of the receptacle; and means for rigidly maintaining each wire loop within the respective receptacle in the housing.

9. The connector assembly of claim 8, wherein said means for maintaining each of said wire loops within the receptacle comprises opposed first and second arcuate fingers having a predetermined length less than said length of the wire segments, wherein said fingers straddle the wire segments and cause the loop end to connect to an opposing electrical contact element through said lower open end of the receptacle.

10. The connector assembly of claim 8, wherein said means for rigidly maintaining the wire loop within the receptacle consists of a mechanical bond between the contiguous first and second parallel wire segments and the inner cylindrical surface of said receptacle.

11. The connector assembly of claim 8, wherein said contiguous first and second generally parallel wire segments are exposed and in electrical contact with each other along said common predetermined length.

12. The connector of claim 8 wherein the housing is electrically non-conductive.

13. The connector of claim 8 wherein the housing is electrically conductive.

14. The connector of claim 8 wherein the housing is magnetically permeable.

15. The connector of claim 8 wherein the electrical contact element is plated with a noble metal.

16. The connector assembly of claim 8 wherein the loop-end is encompassed by a conductive cap.

17. An electrical connector and housing assembly comprising:

a plurality of pairs of contiguous first and second generally parallel insulated wire segments of a common predetermined length ending with electrically-connected bare-wire ends to expose electrical contact elements;

a plurality of receptacles in a housing, each receptacle having a generally cylindrical surface with opposed upper and lower open ends, each pair of wire segments being disposed within one of said receptacles with said electrical contact elements located at the lower end of the receptacle; and means for rigidly maintaining said pairs of wire segments within said receptacles in the housing.

18. The connector assembly of claim 17, wherein said means for maintaining each of the pair of wire segments within the receptacle comprises opposed first and second arcuate fingers having a predetermined length less than said length of the wire segments, wherein said fingers straddle the wire segments and cause the loop end to connect to an opposing electrical contact element through said lower open end of the receptacle.

19. The connector assembly of claim 17, wherein the means for rigidly maintaining each pair of wire segments within said receptacle consists of a mechanical bond between the contiguous first and second parallel wire segments and the inner cylindrical surface of said receptacle.

20. The connector of claim 17, wherein the housing is an electrically non-conductive.

21. The connector of claim 17 wherein the housing is electrically conductive.

22. The connector of claim 17 wherein the housing is magnetically permeable.

23. The connector of claim 17 wherein the bare-wire ends are plated with a noble metal.

24. The connector assembly of claim 17 wherein the bare-wire ends are encompassed by a conductive cap.

* * * * *

UNITED STATES PATENT AND TRADEMARK OFFICE

CERTIFICATE OF CORRECTION

PATENT NO. : 6,010,342
DATED : Jan. 4, 2000
INVENTOR(S) : Troy M. Watson

It is certified that error appears in the above-identified patent and that said Letters Patent is hereby corrected as shown below:

Column 4 line 13:
"FIG. 9C is a cross-sectional view taken along line A-A of FIG. 9B"

has been changed to:
"FIG. 9C is a cross-sectional view taken along line I-I of FIG. 9B"

Column 4 line 24:
"FIG. 10C is a cross-sectional view taken along line B-B of FIG. 10B"

has been changed to:
"FIG. 10C is a cross-sectional view taken along line II-II of FIG. 10B"

Column 7 line 31:
"... shown in section view A-A of FIG. 9C"

has been changed to:
"... shown in section view I-I of FIG. 9C"

Signed and Sealed this

Twelfth Day of December, 2000

*Attest:*

Q. TODD DICKINSON

*Attesting Officer*

*Director of Patents and Trademarks*